US005697549A

United States Patent [19]

Yocum

[11] Patent Number: 5,697,549

[45] Date of Patent: Dec. 16, 1997

[54] CARTON WITH PRIZE COUPON

[75] Inventor: James A. Yocum, West Chester, Pa.

[73] Assignee: Dopaco, Inc., Downingtown, Pa.

[21] Appl. No.: 751,312

[22] Filed: Nov. 18, 1996

[51] Int. Cl.[6] ..... B65D 5/42

[52] U.S. Cl. ..... 229/400; 206/459.5; 206/831; 229/906

[58] Field of Search ..... 229/400, 902, 229/906; 206/459.5, 831; 40/312, 324

[56] References Cited

U.S. PATENT DOCUMENTS

| | | | |
|---|---|---|---|
| 1,983,004 | 12/1934 | Rowland . | |
| 2,054,596 | 9/1936 | Ford | 40/312 |
| 2,180,808 | 11/1939 | Jacobstein et al. . | |
| 2,185,392 | 1/1940 | Amdur . | |
| 3,071,882 | 1/1963 | Eisman et al. | 40/312 |
| 3,099,381 | 7/1963 | Meyers | 206/459.5 |
| 3,220,634 | 11/1965 | Rubinstein | 206/459.5 |
| 3,804,323 | 4/1974 | Bemel | 206/831 |
| 4,232,816 | 11/1980 | Johnson et al. | 206/831 |
| 4,252,264 | 2/1981 | Herbst et al. . | |
| 4,453,664 | 6/1984 | Oliff | 206/831 |
| 4,729,477 | 3/1988 | Growney . | |
| 4,872,555 | 10/1989 | Shadrach, III et al. | 206/831 |
| 5,127,743 | 7/1992 | Miller et al. . | |
| 5,341,923 | 8/1994 | Arasim | 206/459.4 |

FOREIGN PATENT DOCUMENTS

| | | | |
|---|---|---|---|
| 692744 | 8/1964 | Canada | 206/459.5 |

*Primary Examiner*—Gary E. Elkins

*Attorney, Agent, or Firm*—Dennison, Meserole, Pollack & Scheiner

[57] ABSTRACT

A prize concealing member integrally formed by partially severing and folding a tab-forming section of a carton wall to overly and conceal a prize coupon also defined from the wall with both the tab and coupon being selectively severable from the wall.

10 Claims, 3 Drawing Sheets

CARTON WITH PRIZE COUPON

BACKGROUND OF THE INVENTION

The invention is broadly concerned with promotionals, prizes, and the like associated with food cartons.

Possibly the oldest and most well known of such "prize" packages is the Cracker Jack® box which contains a loose prize therein accessible upon an opening of the box and at least a partial removal of the contents depending upon the particular location of the prize.

Other forms of food packages with build-in promotional pieces or prize chambers will be noted in the following two recent patents:

| | | |
|---|---|---|
| 4,729,477 | Growney | 3/8/88 |
| 5,127,743 | Miller et al | 7/7/92 |

In each of these containers, a rather elaborate structure and assembly procedure is involved, Growney requiring the actual construction of a separate chamber while Miller et al requires the use of multiple layers of material.

In the known prior structures, specific additional manufacturing procedures and/or structural elaboration beyond that required in the construction of relatively standardized containers are required. This in turn results in greater expenses which, when multiplied over the millions of disposable cartons utilized, can affect the economic practicability of such cartons.

SUMMARY OF THE INVENTION

It is a primary object of the present invention to provide for the incorporation of a promotional item or promotional material, for example a prize, as an integral part of a conventional or substantially conventional food carton. The carton or container itself will preferably be of the type foldable from a unitary blank of paperboard or the like, including a bottom wall and side walls, with or without a top wall or cover.

In accord with the invention, the provision for a prize or prize notification requires only minimal modification in the cutting of the blank, while allowing for utilization of conventional equipment and conventional procedures. No additional materials are required, other than for an additional spot of adhesive. No additional board material is used.

Basically, the carton of the invention will provide an integral tab which folds over and conceals an adjacent portion of the carton wall which in turn forms the prize or prize coupon. The coupon will have the nature of the prize indicated thereon, for example the phrase "Free Drink".

The tab, preferably formed at or from a free edge portion of one of the carton walls, is free to fold downward over the coupon from an open position in a common plane with the wall, and is bonded to the wall immediately below or otherwise adjacent to the coupon by any appropriate adhesive, for example a cold set glue or a co-adhesive. A co-adhesive will only bond to itself, and hence will require a spot of the appropriate adhesive both on the tab and the carton wall.

It is contemplated that the adhesive be releasable upon a physical pull on the tab so as to expose the coupon. In addition, the coupon is provided with severance lines or lines of weakness which allow a controlled tearing and removal of the tab and the coupon from the carton and, as desired, from each other.

The prize concealing member, comprising both the tab and the coupon, is intended for use with a variety of different types of folded cartons which in turn define receptacles for foodstuffs. Such receptacles can be french fry scoops or cartons as illustrated, hamburger boxes, folded paperboard trays for salads, and the like.

Further details and advantages of the invention will become apparent from the specifics of the invention as more fully hereinafter presented.

DESCRIPTION OF PREFERRED EMBODIMENTS

For purposes of illustration, the carton 10 has been presented as a french fry container or scoop of the type formed from a unitary blank of paperboard or like material. The prize concealing member 12 is an integral component of the carton 10.

The carton 10 will normally include a base or bottom wall 14, a peripheral wall 16 forming a receptacle body with an internal food-receiving chamber, and an upper wall edge defining the mouth of the receptacle. The wall may comprise a single encircling wall panel as in a substantially cylindrical drinking cup, or may include multiple angularly joined wall panels as illustrated with regard to the french fry carton 10.

Figure 10:
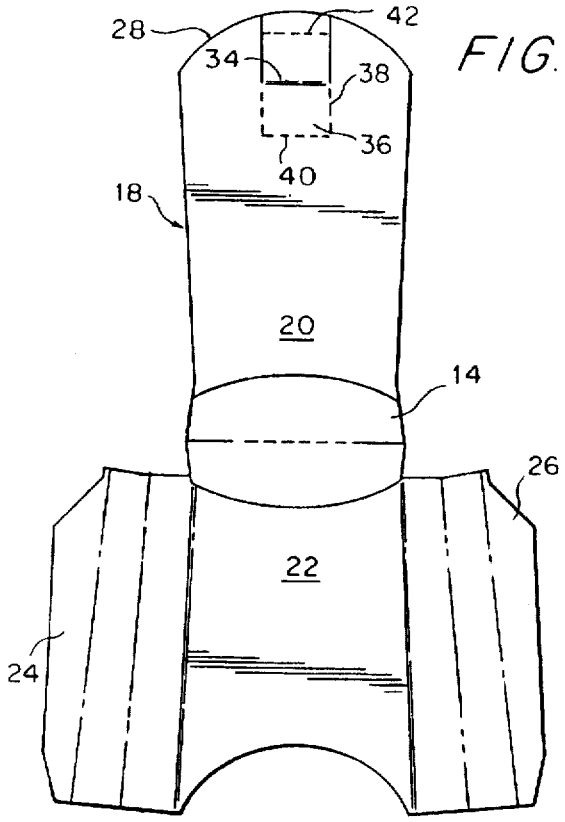
FIG. 10 is a plan view of the blank from which the cartons of FIGS. 1, 2 and 4 are defined.

The carton 10, folded from a blank 18 as illustrated in FIG. 10, includes a rear wall panel 20, a front wall panel 22 and opposed side panels 24 and 26. The wall panels are joined to each other along vertical corner fold lines with the opposed side panels 24 and 26 including intermediate vertical fold lines therein for an expansion of the receptacle body in an obvious manner.

The rear wall panel 20, as is common, is formed with an upper arcuate outer edge 28 forming, with the rear wall panel, a scoop configuration.

The integral prize concealing member 12 is formed at the upper edge portion of the rear wall panel 20 and includes a rectangular concealing tab 30, having an outer adhesive extension or flap 32, centrally located along the convex upper edge 28 and inwardly foldable along fold line 34 defining the inner edge of the tab 30 to overly the inner face of the rear wall panel 20 immediately therebelow.

The rear wall panel 20, immediately below the tab fold line 34, comprises, as a portion of the prize concealing member, a prize coupon 36 which is of a width and height substantially equal to that of the tab 30 other than for the adhesive extension or flap 32. The coupon 36 has the side edges thereof defined by severance lines or tear lines 38. The lower edge of the coupon is defined by a similar severance line 40. The adhesive flap 32, by any appropriate adhesive such as a co-adhesive on the flap and the face of the wall panel 20, is adhesively secured immediately below the coupon 36, thus concealing the coupon and the indication of the prize, which will normally be printed directly on the coupon.

To expose the prize coupon 36, one need merely pull up on the adhesive flap 32, the adhesive allowing for this separation upon a positive manual force. Inasmuch as one would normally wish to preserve the prize coupon while throwing away the empty food container or carton, the severance lines 38 and 40 allow for a removal of the coupon 38 along with the concealing tab 30. At the same time, it is also preferred that a severance line 42 be provided between the adhesive flap 32 and the tab 30 to allow for a disposal of this flap as a further convenience in retaining the prize coupon for subsequent collection of the prize. Incidentally, the coupon may in itself be a prize with the indicia thereon illustrating an animal, a famous historical person, or the like. This would be particularly attractive to children. In such case, a severance line might also be provided along the fold line 34 between the tab 30 and coupon 36 for a removal of the tab from the coupon. It will also be recognized that appropriate indicia can be provided on the normally concealed or inner face of the tab, for example a continuation of a scene portrayed on the prize coupon itself.

As will be appreciated, the tab and coupon are formed directly from the material of the rear wall panel, no additional paperboard material is required. Rather, all that is necessary is provision for a die cutting of the opposed side edges of the tab and the formation of tear lines about the coupon itself. The actual width of the tab and coupon can vary. However, it is preferred that a portion of the scooping upper end of the rear wall 20 be retained to oppose sides of the notch, defined by a folding of the tab 30, sufficient to retain a degree of stiffness and allow continued use as a scoop.

Figure 1:
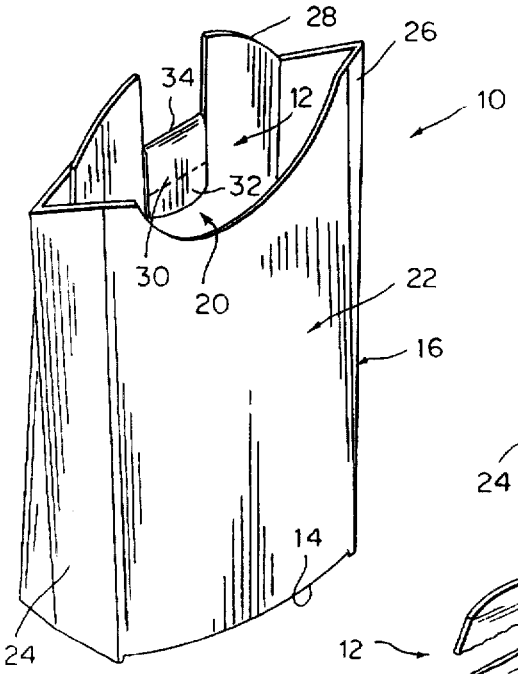
FIG. 1 is a perspective view of a carton with the integral prize concealing member foldable within the interior of the receptacle body and formed from the rear or scoop wall thereof.
Figure 2:
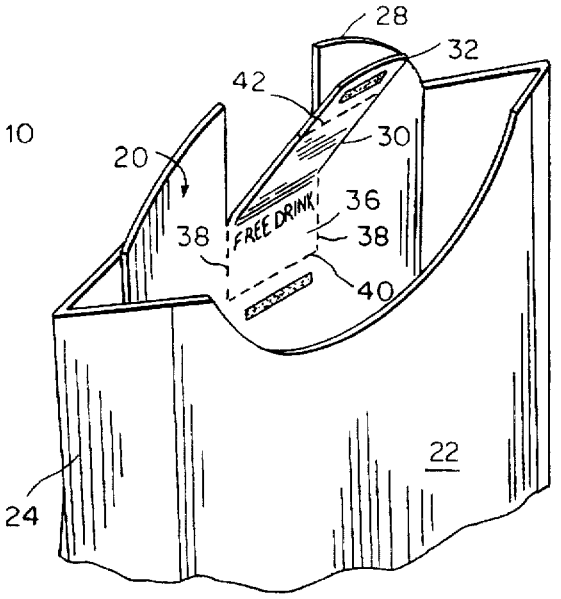
FIG. 2 is a perspective view of the carton of FIG. 1 with the prize concealing member opened to disclose the prize.
Figure 3:
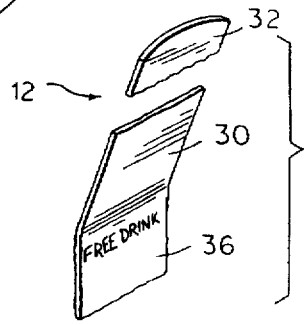
FIG. 3 is a perspective view of the prize concealing member separated from the carton and with the adhesive flap or extension exploded.
Figure 4:
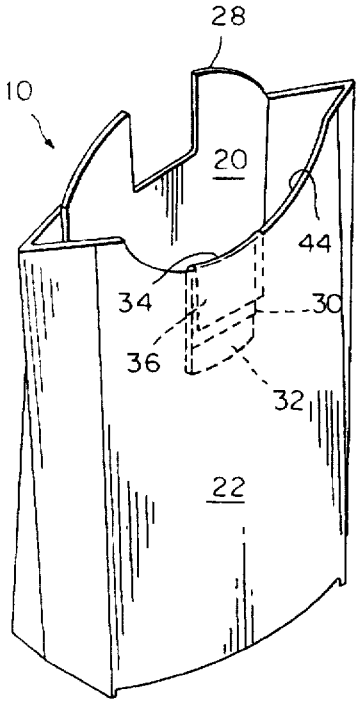
FIG. 4 is a perspective view of a carton similar to the carton of FIG. 1 with the prize concealing member positioned on the interior of the front wall.
Figure 11:
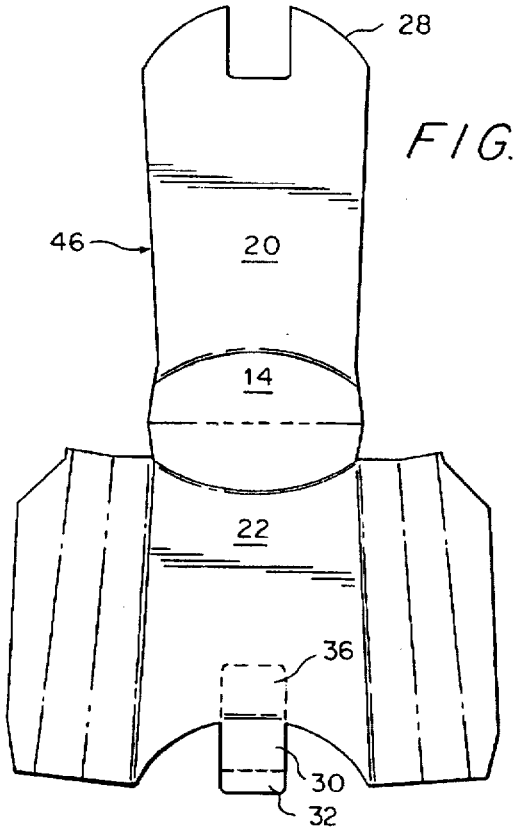
FIG. 11 is a plan view of the blank from which the carton of FIG. 5 is formed.

FIG. 4 illustrates a variation wherein the prize concealing member 12 is on the front wall panel 22 of the carton 10 and positioned to the interior thereof. In this embodiment, the tab 30 is integral with and extends outward or upward from the central portion of the upper edge 44 of the front wall panel 22. As will be noted in FIG. 4 and in the blank 46 in FIG. 11, the tab 12, and adhesive flap 32 integral therewith along the severance line 42, when formed with a series of aligned duplicate blanks, produces a corresponding notch 48 in the rear wall panel 20. In this manner, the prize concealing member 12 is formed without the addition of any material. It will also be noted that the prize coupon 36 is defined by the appropriate severance lines 38 in the front wall panel 22 immediately below the tab 12 for concealment thereunder upon a folding of the tab.

In this embodiment, it may be necessary to partially consume the contents of the carton to allow easy access to the adhesive flap 32 to upwardly unfold the tab and expose the prize coupon. Alternatively, in light of the severance lines which define the prize coupon and the severance line between the tab and the adhesive flap, it is also possible for one to merely grasp the overlying tab and coupon and tear this assembly from the carton, thus immediately removing the prize concealing member without disturbing the contents.

Figure 5:
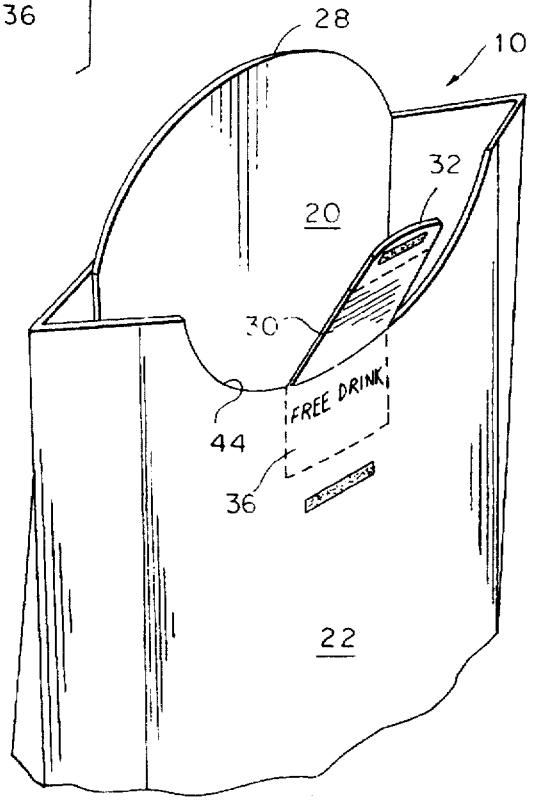
FIG. 5 is a perspective view of a similar carton with the prize concealing member positioned on the exterior of the front wall with the concealing tab partially open.

FIG. 5 illustrates a further variation wherein the only difference from the embodiment of FIG. 4 is the orientation of the prize concealing member 12 with the coupon indicia being on the outer face of the front wall 22 and with the concealing tab folded outward and downward to overlie the front face of the front wall panel 22. For purposes of illustration, FIG. 5 shows the tab and adhesive flap opened to expose the prize coupon 36. To preserve the coupon for future use, the coupon will be removed from the wall panel 22 by a severance therefrom along the severance lines 38. The adhesive flap will also preferably be removed along severance line 42. If so desired, a further severance line can be provided between the tab and coupon.

Referring now more specifically to FIGS. 6–9 and 12, a substantially wider form of prize concealing member 50, defined from the rear wall panel 52, has been illustrated therein.

The folding tab 54 of the prize concealing member 50, noting FIGS. 8 and 12 in particular, comprises substantially the entire upper scooping portion of the rear wall 52 down to a point, defined by opposed cut lines 56, slightly below the general upper edge of the carton. The tab 54, when folded to overlie the coupon 58 immediately therebelow, will leave, to the opposite sides thereof, a pair of upwardly projecting extensions 60 which retain, to some degree, the ability to use the upper portion of the rear wall panel 52 as a scoop for french fries or the like.

The prize coupon 58, defined from the rear wall panel 52 by severance lines along the opposed sides and bottom edge thereof, is of substantially equal width with the prize concealing tab 54. As such, even when completely severed, the coupon is still of an appreciable size easily held and retained for immediate or future use.

The tab 54, central along the outer edge thereof, is provided with a narrow transversely elongate extension 62 which carries a strip of an appropriate adhesive or co-adhesive 64 for a releasable bonding of the tab 54 in its downwardly folded and closed position. Note for example the possibility of providing a strip 66 of an appropriate co-adhesive on the rear wall panel 52 below the coupon 58 for engagement of the adhesive strip 64 therewith.

The adhesive carrying extension 62 is coplanar with the tab 54 and, because of the relatively thin nature thereof, not necessarily foldable relative thereto or severable therefrom. Rather, and as will be best appreciated from FIG. 9, the entire tab 54 with the adhesive extension 62 is intended to be easily severed from the coupon 58 along the severance line or line of weakness 68 which also constitutes the fold line between the tab and coupon about which the tab folds to conceal the coupon.

Figure 6:
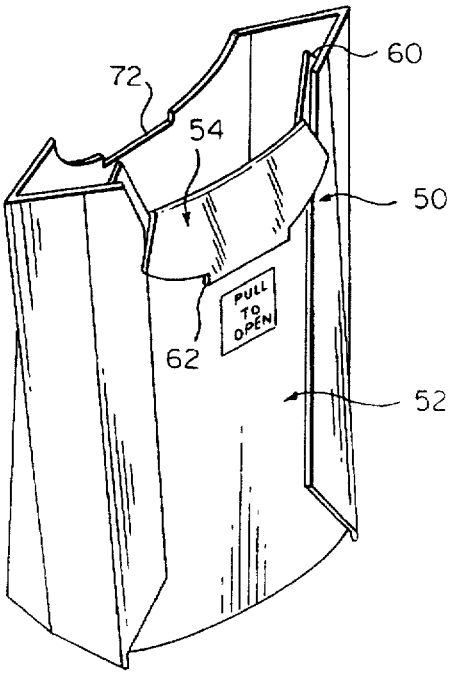
FIG. 6 is a rear perspective view of a carton with a modified form of prize concealing member on the outer surface thereof.
Figure 7:
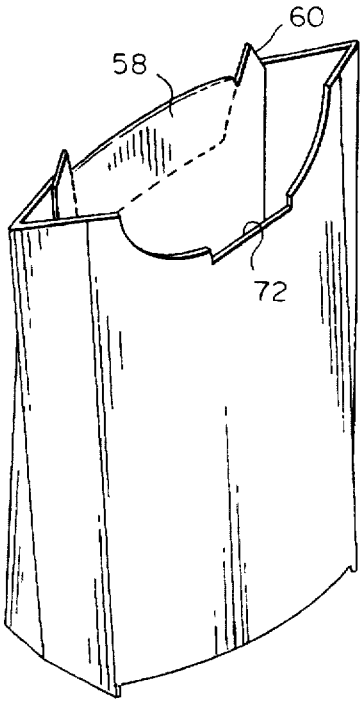
FIG. 7 is a front perspective view of the carton of FIG. 6.
Figure 8:
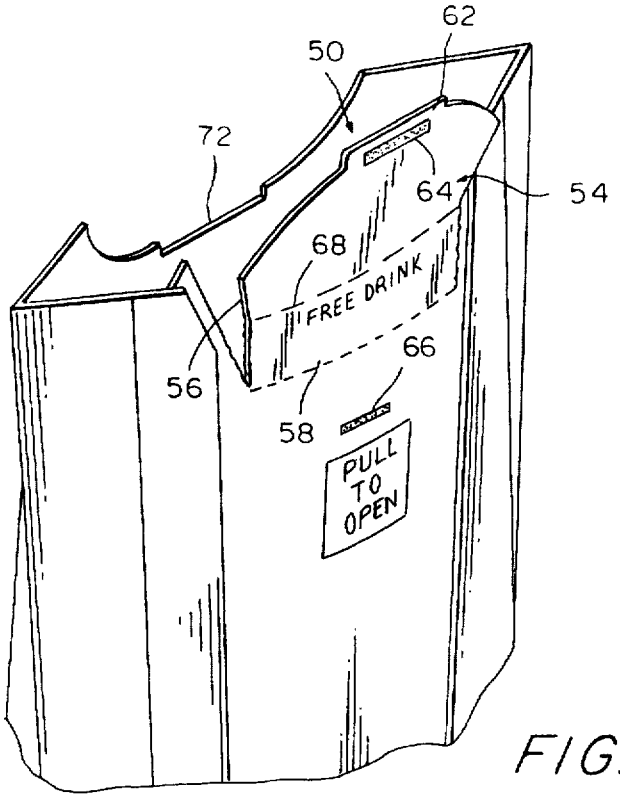
FIG. 8 is a rear perspective view with the prize concealing member partially open and partially severed from the wall.
Figure 9:
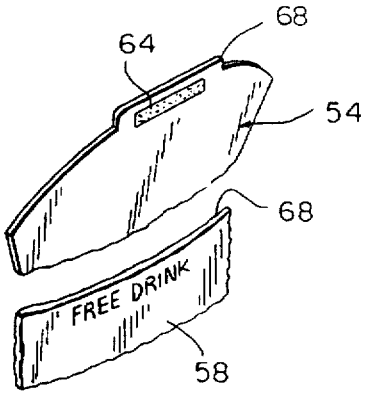
FIG. 9 is a perspective view of the prize concealing member with the tab separated from the coupon.
Figure 12:
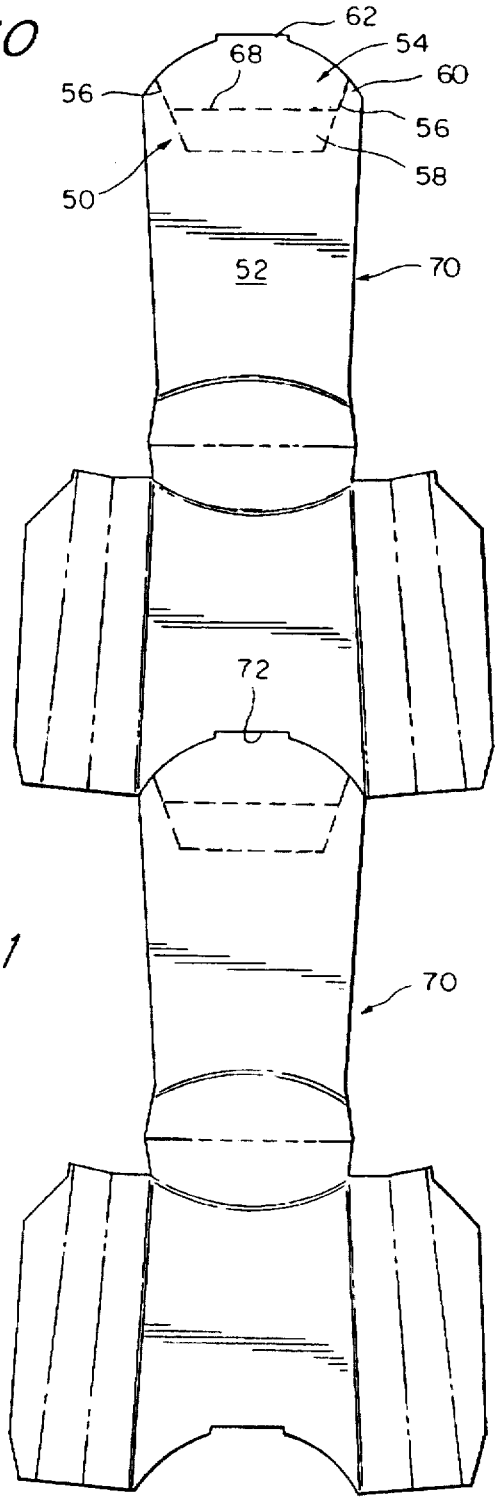
FIG. 12 is a plan view of the blank, and a pattern layout for the cutting of the blank, from which the carton of FIGS. 6, 7 and 8 is defined.

Noting FIG. 12, the blank 70 for the carton of FIGS. 6–8 is preferably formed as one of a sequence of duplicate blanks 70 with the adhesive extension 62 producing a minor depression 72 in the upper edge of the front wall panel 74 of the next adjacent duplicate blank. These recesses 72, as will be appreciated from a viewing of the erected carton, have no affect on the usable volume of the carton. It will also be recognized that the formation of the prize concealing member 50, in the manner suggested in FIG. 12, requires no additional material. The minor amount of adhesive required will be easily applied at the time of the application of the adhesive required for the assembly of the carton itself. Similarly, the printing of indicia on the prize coupon can be effected at the time of the printing of the carton indicia. It is also possible, particularly when using co-adhesives on the tab and carton body, that the prize indicia can be applied and the tab closed at the point of sale, for example a fast food restaurant.

The prize coupon can be retrieved without destruction of the carton and without any substantial reduction in the ability of the carton to retain the packaged foodstuffs.

While the coupon has been primarily referred to as a prize coupon, it is to be appreciated that the term "prize" is intended to encompass a wide range of promotional materials.

The foregoing is illustrative of the principals of the invention. As additional variations may occur to those skilled in the art, it is not intended to limit the invention to the illustrated embodiments. Rather, all obvious variations, within the parameters of the claims following hereinafter, are to be considered within the scope of the invention.

I claim:

1. A carton with an integral prize concealing member, said carton including a carton wall, said concealing member including a tab integral with said wall and foldable between a first open position in a substantially common plane with said wall and a second closed position overlying a section of said wall adjacent said tab, said tab in said second closed position cooperating with said section of said wall in concealing promotional material, and means for releasably securing said tab in said second position, said wall section comprising a coupon, and severance lines between said coupon and said carton wall adjacent said coupon wherein said coupon is selectively severable from said wall.

2. The carton of claim 1 including a further severance line between said coupon and said tab.

3. The carton of claim 1 wherein said wall has a free upper edge, said tab being defined from said wall and extending downward from said wall upper edge to a lower tab edge at said coupon, said lower tab edge being defined by a transverse fold line between said tab and said coupon generally paralleling said wall upper edge.

4. The carton of claim 1 wherein said wall has a free upper edge, said tab projecting from said upper edge with a fold line defined at said upper edge between said tab and said wall for a selective folding of said tab over said wall.

5. The carton of claim 1 wherein said means for securing said tab in said second position comprises an extension integral with said tab and adhesive means on said extension for adhesively securing said extension and said tab to said carton wall.

6. The carton of claim 5 including a severance line between said tab and said extension for selective removal of said extension from said tab.

7. The carton of claim 1 wherein said promotional material is presented by indicia on said coupon.

8. In a folded paperboard container including a container wall, a tab integral with said wall and foldable between a first open position in a substantially common plane with said wall and a second closed position overlying a section of said wall adjacent said tab, said tab in said second closed position cooperating with said section of said wall in concealing promotional material, said wall section comprising a coupon, and severance lines between said coupon and said container wall adjacent said coupon wherein said coupon is selectively severable from said wall.

9. The container of claim 8 wherein said wall defines an upwardly opening receptacle with a free upper edge, said tab extending from said wall upper edge and being foldable into said receptacle to said second position.

10. The container of claim 9 including means for securing said tab in said second position comprising an extension integral with said tab and adhesive means on said extension for adhesively securing said extension and said tab to said container wall.

* * * * *